US006981398B2

(12) United States Patent
Toben et al.

(10) Patent No.: US 6,981,398 B2
(45) Date of Patent: Jan. 3, 2006

(54) SEAM CLOSING APPARATUS

(75) Inventors: John J. Toben, Cedar Rapids, IA (US); Michael C. Borwig, Swisher, IA (US)

(73) Assignee: Met-Coil Systems Corporation, Westfield, MA (US)

( * ) Notice: Subject to any disclaimer, the term of this patent is extended or adjusted under 35 U.S.C. 154(b) by 0 days.

(21) Appl. No.: 10/668,842

(22) Filed: Sep. 23, 2003

(65) Prior Publication Data

US 2004/0093924 A1 May 20, 2004

Related U.S. Application Data

(60) Provisional application No. 60/412,723, filed on Sep. 23, 2002.

(51) Int. Cl.
*B21D 39/02* (2006.01)

(52) U.S. Cl. ..... 72/211; 29/243.58

(58) Field of Classification Search ..... 29/243.5, 29/243.58; 72/210, 211

See application file for complete search history.

(56) References Cited

U.S. PATENT DOCUMENTS

| | | | | |
|---|---|---|---|---|
| 2,660,909 | A * | 12/1953 | Morse et al. | 72/211 |
| 4,470,186 | A * | 9/1984 | Knudson | 29/243.5 |
| 4,989,308 | A * | 2/1991 | Sanders | 29/243.5 |
| 5,189,784 | A | 3/1993 | Welty | |
| 5,243,750 | A | 9/1993 | Welty | |
| 5,450,879 | A | 9/1995 | Toben | |
| 6,056,021 | A | 5/2000 | Iizuka | |
| 6,105,227 | A | 8/2000 | Bota | |
| 6,378,184 | B1 | 4/2002 | Bota | |

* cited by examiner

*Primary Examiner*—Lowell A. Larson
(74) *Attorney, Agent, or Firm*—McCormick, Paulding & Huber LLP

(57) ABSTRACT

A seam closing apparatus for use in sealing a duct seam having an outwardly extending sealing portion and a lower fold includes a handle portion having a power actuation trigger and a first roller for engaging the outwardly extending sealing portion of the duct seam. A second roller is also provided for engaging the lower fold of the duct seam. Operation of the power actuation trigger causes the first roller to rotate in a first direction, thereby flattening the outwardly extending sealing portion of the duct seam.

19 Claims, 7 Drawing Sheets

SEAM CLOSING APPARATUS

CROSS REFERENCE TO RELATED APPLICATIONS

This application claims the benefit of U.S. Provisional Application Ser. No. 60/412,723, filed on Sep. 23, 2002, herein incorporated by reference in its entirety.

FIELD OF THE INVENTION

This invention relates in general to a seam closing apparatus, and deals more particularly with a seam closing apparatus, which is capable of closing seams in ductwork via one pair of closing rollers.

BACKGROUND OF THE INVENTION

Rectangular or box-shaped ducts are extensively utilized in heating and ventilating systems to distribute heated or cooled air throughout a structure. These ducts are commonly formed from differing gauges of sheet metal in sections of predetermined lengths, which are then connected to one another to form a continuous duct for distributing air.

Typically, each section of duct is formed by bending two pieces of sheet metal of the desired length at a 90° angle. One edge of each piece is formed to include a longitudinally extending groove, forming thereby the female portion of the seam, while the other longitudinal edge of each piece is bent over along its length to form thereby the male portion of the seam. The two pieces are then assembled by inserting the male portion of each piece into the female portion, leaving an edge extending beyond the joint from the female portion. This extended edge must then be bent over to lock the seam. One industry standard example of such a seam is a 'Pittsburgh' lock or seam.

A seam closing tool is utilized to complete the sealing process by bending over the extended edge of the female portion. Known seams, such as the Pittsburgh seam, include an extended edge which extends approximately perpendicularly to its final, sealed position. Consequently, the seam closing tool must employ a plurality of rollers to gradually bend, or form, the extended edge over to its final sealed position, each of the plurality of rollers bending the extended edge over to a greater degree until the final sealing position is attained. It is also known to utilize either a manual or pneumatically actuated hammer to bend or form over the extended edge of the female portion.

While these known sealing systems are successful to a degree, they suffer from several logistical problems. Firstly, the multi-roller seam closing tool cannot completely seal the entire length of a given seam at those locations adjacent the end of the seam. This inability to completely seam the length of the seam is due to the graduated sealing angles inherent in each of the plurality of rollers of the seam closing tool. That is, it is the last of the rollers which has the most severe sealing angle and accomplishes the final sealing operation of the seam closing tool, however the last roller is preceded by all of the other rollers and, therefore, will not be permitted to reach or affect the last few feet or inches of the seam. Hammering will thus be necessary to finish the complete seal of the seam.

Similarly, the manual or pneumatic hammering of the seam in its entirety is highly labor intensive and quite loud, oftentimes requiring ear protection for the operators who assemble the finished duct work. Moreover, the time and effort extended on hammering the extended edge of the female portion over to seal the seam, can substantially increase the time and expense of any duct fabrication and installation job, typically by as much as 50% or more.

With the forgoing problems and concerns in mind, it is the general object of the present invention to provide a seam closing apparatus which overcomes the above-described drawbacks while maximizing effectiveness and flexibility in the assembling process.

SUMMARY OF THE INVENTION

It is an object of the present invention to provide a seam closing apparatus.

It is another object of the present invention to provide a seam closing apparatus that can be utilized along the entire length of a duct seam.

It is another object of the present invention to provide a seam closing apparatus that utilizes only a single pair of driven rollers.

It is another object of the present invention to provide a seam closing apparatus that requires no hammering to completely seal a duct seam.

It is another object of the present invention to provide a seam closing apparatus that can assuredly track the length of a duct seam.

It is another object of the present invention to provide a duct fastseam that is capable of maintaining the duct in a substantially square condition even when the fastseam has yet to be completely sealed.

It is another object of the present invention to provide a seam closing apparatus that can be operated quietly and by a single person.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
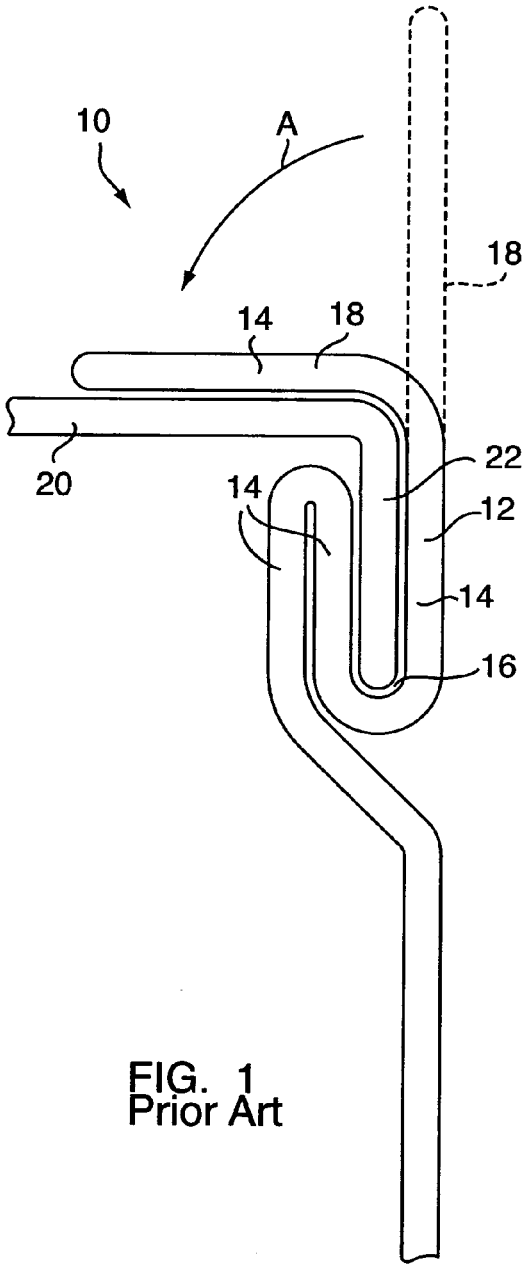
FIG. 1 Prior Art
FIG. 1 is a cross-sectional view of a known duct seam.

FIG. 1 illustrates a cross-sectional view of a known duct seam 10, commonly referred to in the field as a 'Pittsburgh' seam. As shown in FIG. 1, the seam 10 includes a female portion 12 which is formed by repetitively bending, or roll forming, the duct material, typically sheet metal or the like, so as to form three substantially parallel folds 14. The folds 14 serve to define a female groove 16, wherein one of the folds 14 preliminarily extends beyond the duct edge to establish a sealing portion 18.

The seam 10 further includes a longitudinal section of the duct wall 20 which is bent at a substantially right angle to form a male portion 22. As will be appreciated, the male portion 22 is sized for tight fitting within the female groove 16 of the female portion 12 when fully assembled.

In operation, the male portion 22 of the seam 10 is initially fitted into the female groove 16 when the sealing portion 18 remains in its unsealed position, as represented by the dashed lines in FIG. 1.

Once the male portion 22 has been inserted into the female groove 16, the sealing portion 18 must then be hammered or otherwise bent down, in the direction of the arrow A, against the duct wall 20 in order to complete the sealing of the seam 10. The hammering over of the sealing portion 18 is typically accomplished either manually, or with the use of a pneumatic hammer or the like. It will be readily appreciated that the hammering of the male portion 22 and the sealing portion 18 is highly time consuming and oftentimes noisy to the point of being injurious to the ears of the operators who are assembling the seam 10.

A known, multi-roller seam closing tool may also be utilized to close the seam 10. As shown in FIG. 1, the sealing portion 18 must be bent, or formed, from its approximately perpendicular position (shown in dashed lines) to its sealed position and, therefore, a multitude of rollers are required to incrementally bend or form the sealing portion. As discussed previously, the utilization of such a multi-roller seam closing tool is unsatisfactory as manual or power-assisted hammering must still be employed to seal the last few feet or inches of the seam.

Figure 2:
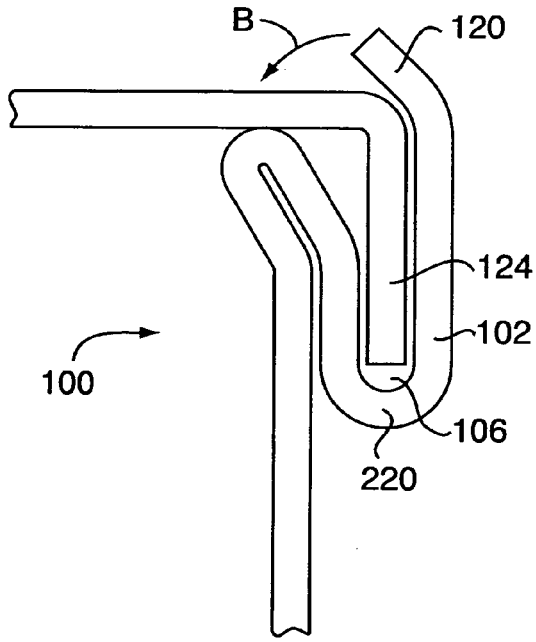
FIG. 2 is a cross-sectional view of the male and female ends of a duct fastseam.

In contrast, FIG. 2 illustrates the male and female portions of a fastseam 100 which is currently the subject matter of a co-pending application. As shown in FIG. 2, the fastseam 100 includes a male portion 124 inserted within a groove 106 of a female portion 102. The female portion 102 further includes a sealing portion 120, which will be bent in the direction of arrow B in order to seal the fastseam 100.

Figure 3:
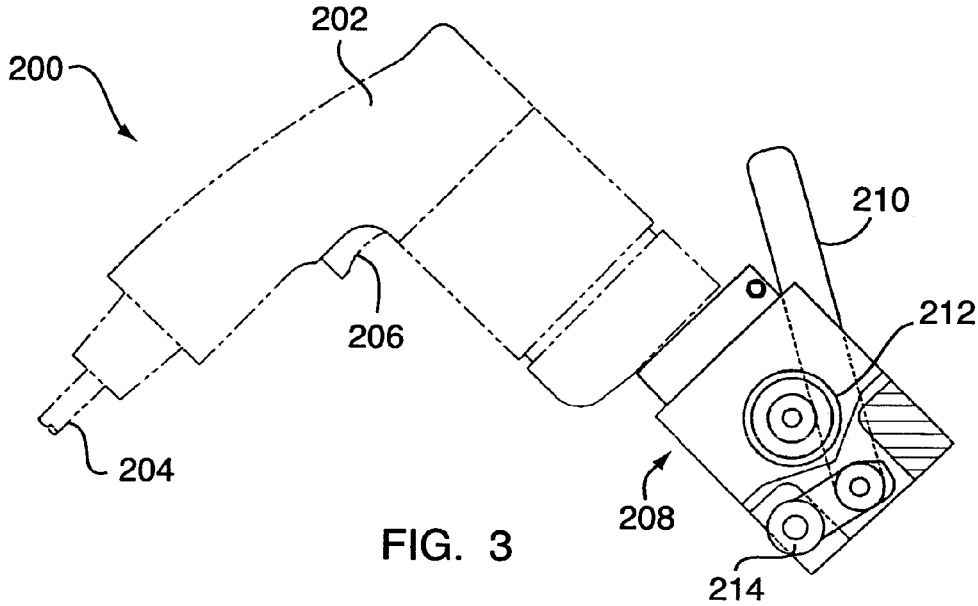
FIG. 3 is a partial cross-sectional view of a seam closing apparatus, according to one embodiment of the present invention.

Turning to FIG. 3, a partial cross-sectional view of a seam closing apparatus 200 is shown, according to one embodiment of the present invention. As shown in FIG. 3, the seam closing apparatus 200 includes a housing 202, a power supply cord 204, which may be either electrical or pneumatic in design, and an actuation trigger 206. An operation end 208 is generally shown in FIG. 3 and includes a pivot handle 210, a drive roller 212 and a idler roller 214. Owing partially to the configuration of the sealing portion 120 of the fastseam 100, shown in FIG. 2, the seam closing apparatus 200 is capable of completely closing the fastseam 100 along its entire length without necessitating a hammering step or the like.

Figure 4:
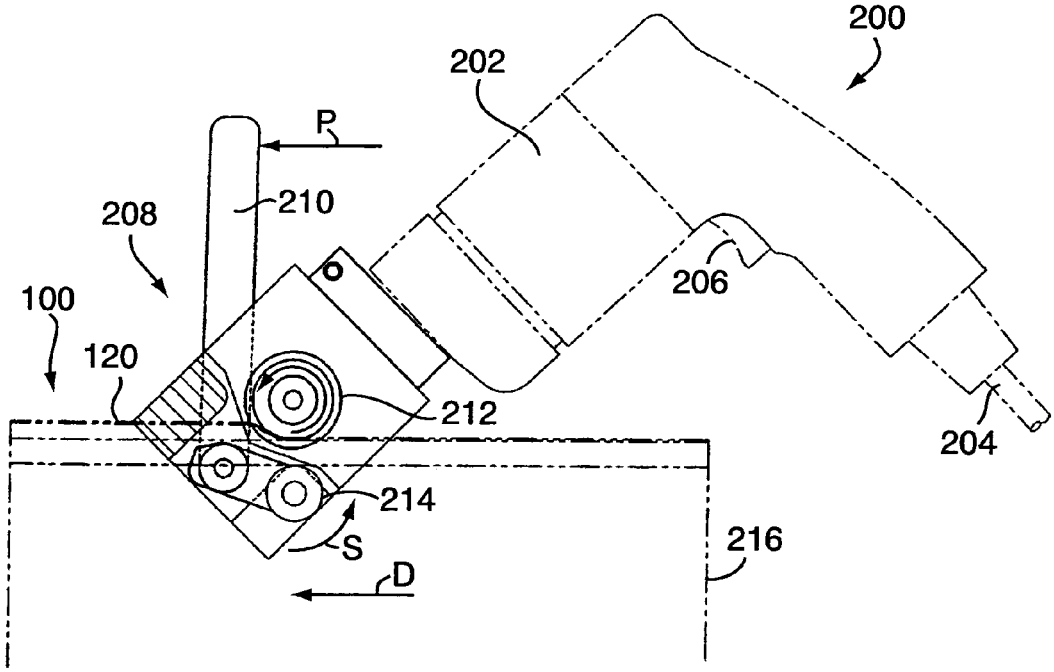
FIG. 4 is a partial cross-sectional view of the seam closing apparatus shown in FIG. 3 as it operates upon a duct seam.

FIG. 4 illustrates the seam closing apparatus 200 as it is applied to the fastseam 100 of a length of duct 216. As shown in FIG. 2, when pressure is applied to the pivot handle 210 in the general direction of the arrow P, the idler roller 214 will swing upwards in the general direction of the arrow S, thus capturing the fastseam 100 between the drive roller 212 and the idler roller 214. The drive roller 212 will thereby flatten the partially angled sealing portion 120 under force of the engagement of the idler roller 214 and the operator's downward pressure of the housing 202.

Once the seam closing tool 200 has engaged the fastseam 100, the operator will then actuate the trigger 206 and cause thereby the drive roller 212 to rotate in the counterclockwise direction (as seen in FIG. 4), propelling the seam closing tool 200 in the direction of arrow D while flattening the sealing portion 120 to its completely sealed position. It will be readily appreciated that the pivot handle 210 may be continuously biased in the direction of arrow P by the operator during operation or, alternatively, a latch may be formed so as to hold the pivot handle 210 in its engaging position.

It is therefore an important aspect of the present invention that the seam closing tool 200 utilizes only a single, driven roller 212 to bend or form the sealing portion 120 to its completely sealed position. Moreover, by employing only a single driven roller 212 which is not preceded by a plurality of additional, incremental rollers, the seam closing apparatus 200 of the present invention will permit the driven roller 212 to transverse and seal the entirety of the fastseam 100 without requiring the additional time, expense and audible discomfort of a hammering operation.

Figure 5:
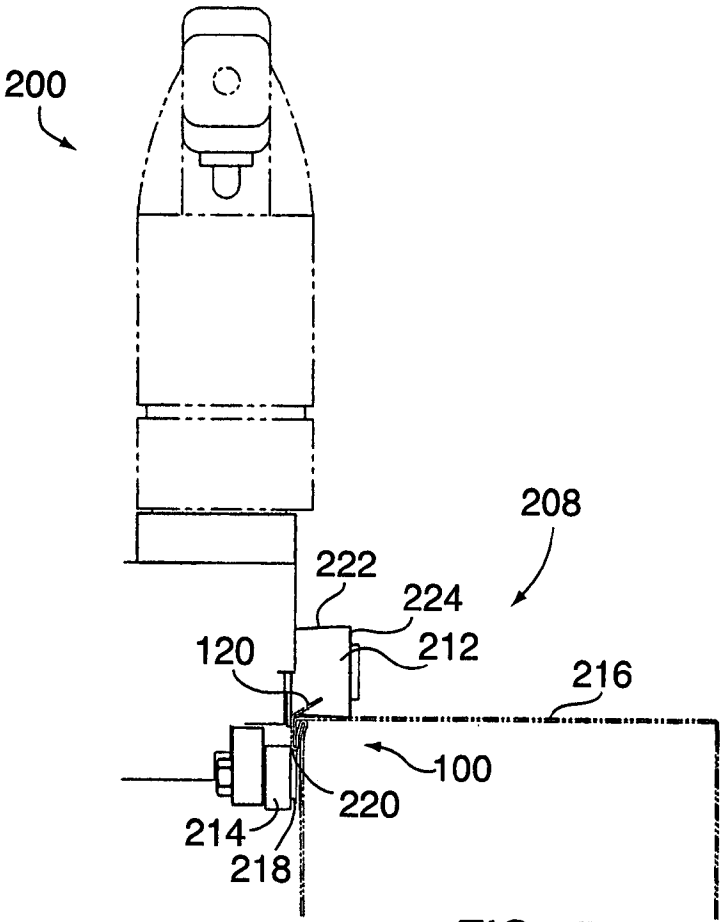
FIG. 5 is a partial cross-sectional view of the seam closing apparatus as it engages the seam of a duct.

FIG. 5 illustrates an end view of the seam closing apparatus 200 as it is engaged with the fastseam 100. As shown in FIG. 5, the idler roller 214 includes an annular groove 218 which serves to receive the lower bend 220 (also shown in FIG. 2) of the fastseam 100, thereby ensuring a secure lock upon, and tracking of, the fastseam 100 as the seam closing apparatus 200 is driven down the length of the fastseam 100.

It should also be noted that the driven roller 212 includes an angled profile 222 such that, as shown in the cross-sectional view of FIG. 5, the circumference of the driven roller 212 is smaller in the area adjacent the seam closing apparatus 200 than it is at the exterior side 224 of the driven roller 212. In this manner, the eccentrically formed driven roller 212 ensures a tight seal of the sealing portion 120 against the duct wall 216.

Figure 6:
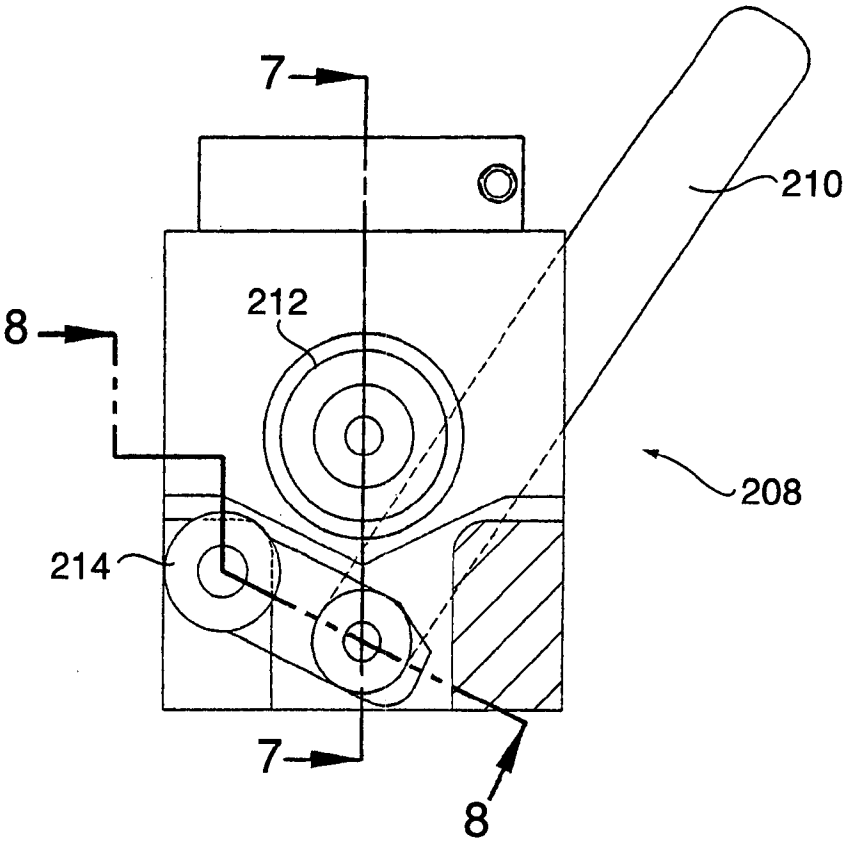
FIG. 6 is a partial cross-sectional view of the operation end of the seam closing apparatus shown in FIG. 3.
Figure 8:
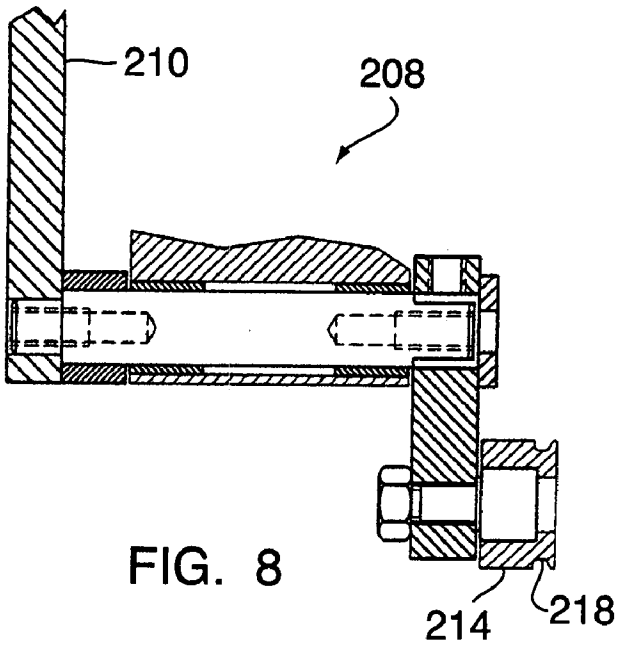
FIG. 8 is a cross-sectional view of the operation end of the seam closing apparatus taken along lines B—B.
Figure 7:
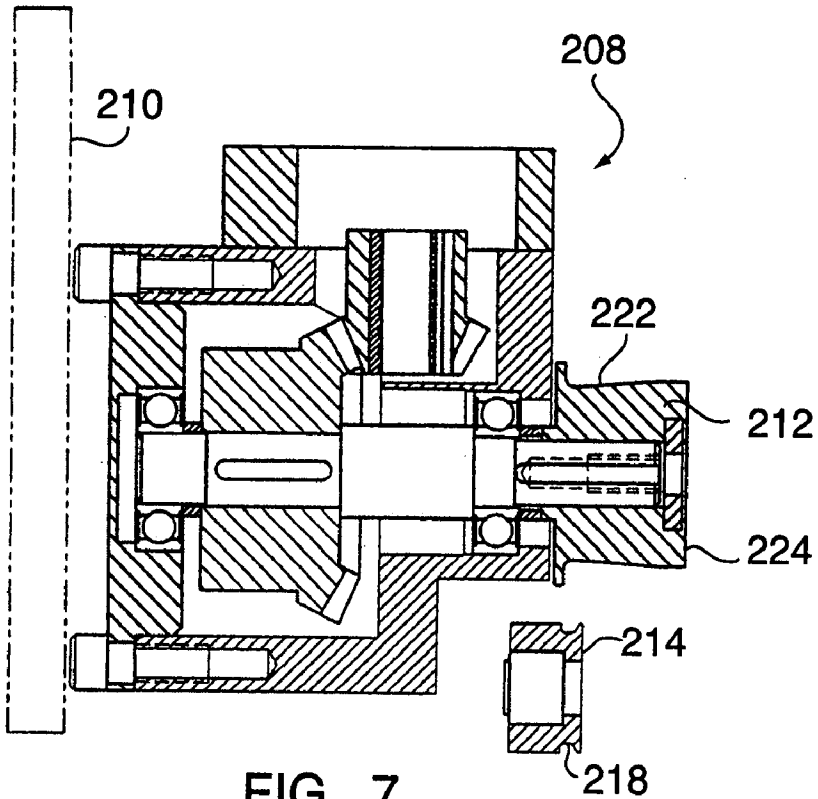
FIG. 7 is a cross-sectional view of the operation end of the seam closing apparatus taken along lines A—A.

FIG. 6 illustrates a partial cross-sectional side view of the operation end 208 of the seam closing apparatus 200. FIG. 7 illustrates the section A—A taken through the operation end 208, while FIG. 8 illustrates the section B—B taken through the operation end 208.

While the seam closing apparatus 200 has been described as including a pivot handle 210 and a displaceable idler roller 214, the present invention is not limited in this regard. Alternative embodiments of the present invention are envisioned to include a seam closing apparatus having no pivot handle 210, having instead only an idler roller which is fixed in position with respect to the driven roller 212. In this embodiment, an operator need only depress the driven roller 212 onto the sealing portion 120 until the groove 218 of the idler roller is capable of latching onto the lower bend 220 of the fastseam 100.

Figure 9:
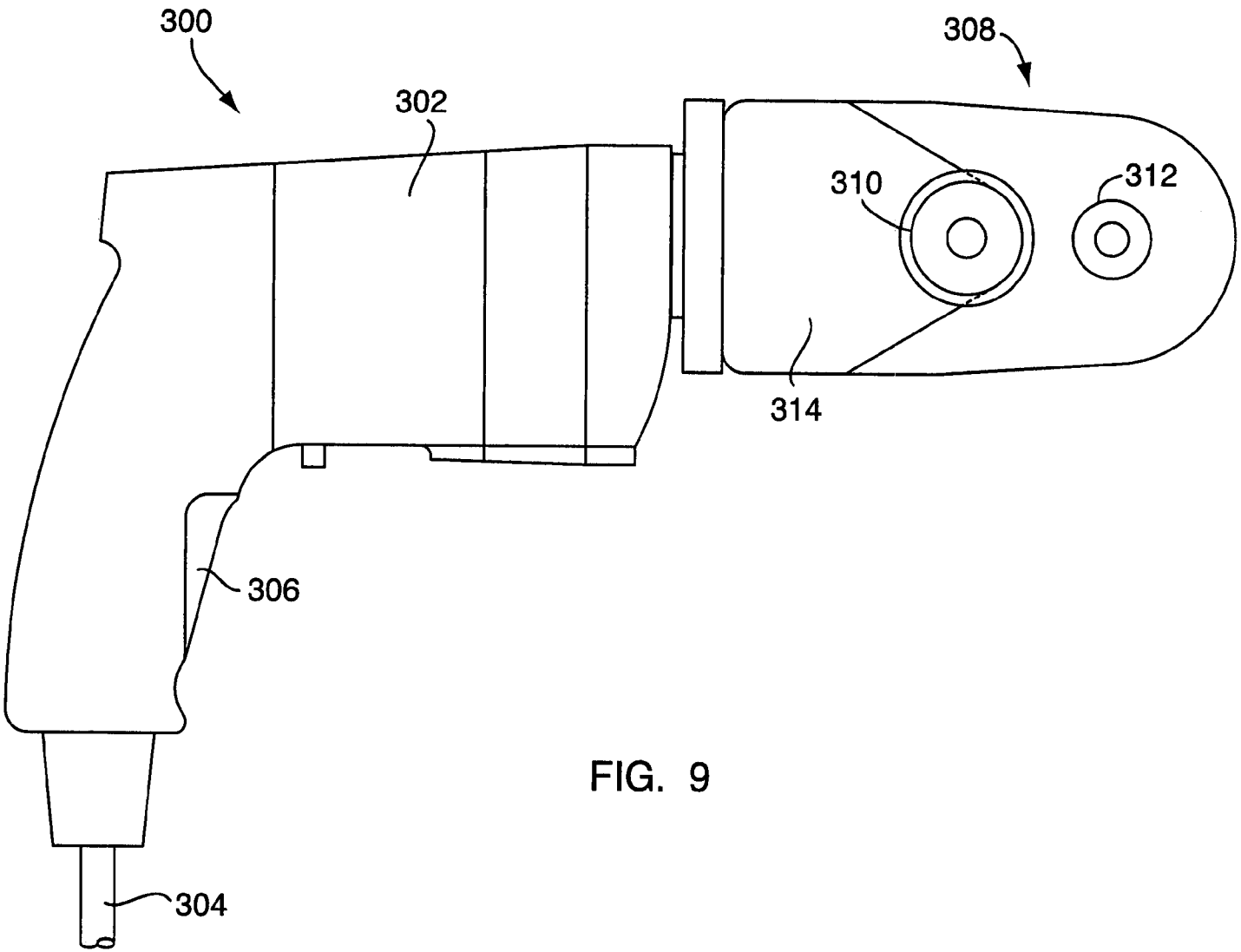
FIG. 9 is a planar view of a seam closing apparatus, according to another embodiment of the present invention.

Turning to FIG. 9, a side plan view of a seam closing apparatus 300 is shown, according to another embodiment of the present invention. As shown in FIG. 9, the seam closing apparatus 300 includes a housing 302, a power supply cord 304, which may be either electrical or pneumatic in design, and an actuation trigger 306. An operation end 308 is generally shown in FIG. 9 and includes a drive roller 310, a idler roller 312 and a raised abutment surface 314. Owing partially to the configuration of the sealing portion 120 of the fastseam 100, shown in FIG. 2, the seam closing apparatus 300 is capable of completely closing the fastseam 100 along its entire length without necessitating a hammering step or the like.

Figure 10:
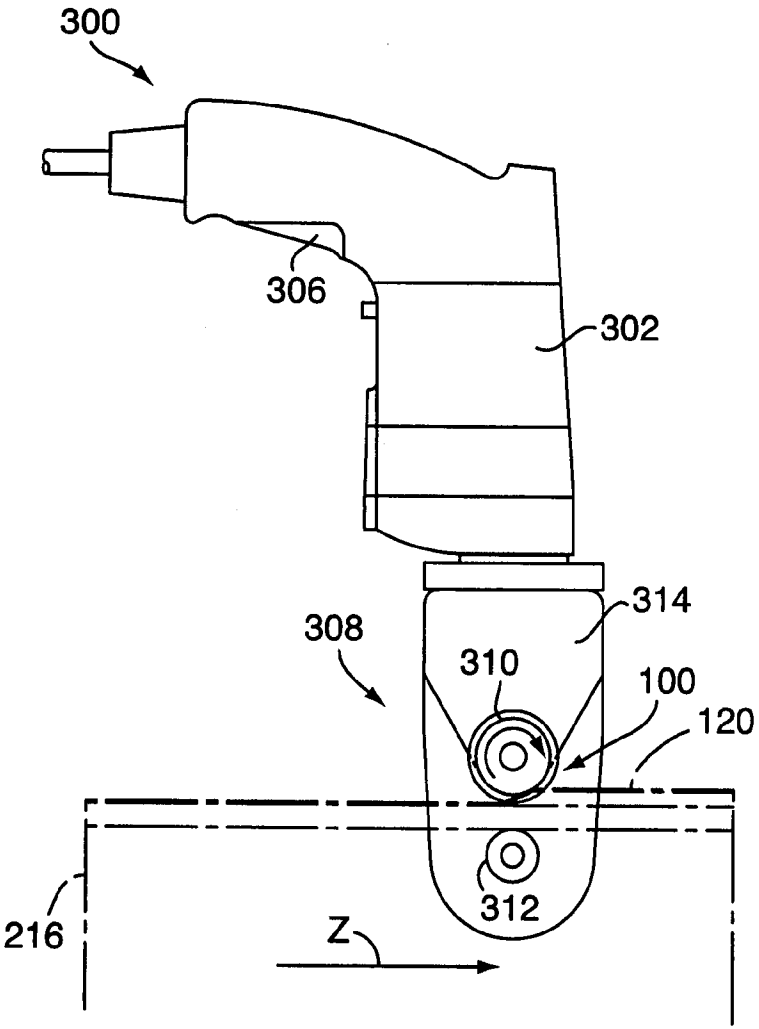
FIG. 10 illustrates the seam closing apparatus of FIG. 9 as it is first applied to a seam of a duct.

FIG. 10 illustrates the seam closing apparatus 300 as it is first applied to the fastseam 100 of a length of duct 216. As shown in FIG. 10, the seam closing apparatus 300 is applied to the fastseam 100 in a vertical orientation, bringing the drive roller 312 into contact with the sealing portion 120 of the fastseam 100. As will be discussed in more detail later, the idler roller 312 includes a groove formed thereon to accommodate the bottom edge of the fastseam 100.

Figure 11:
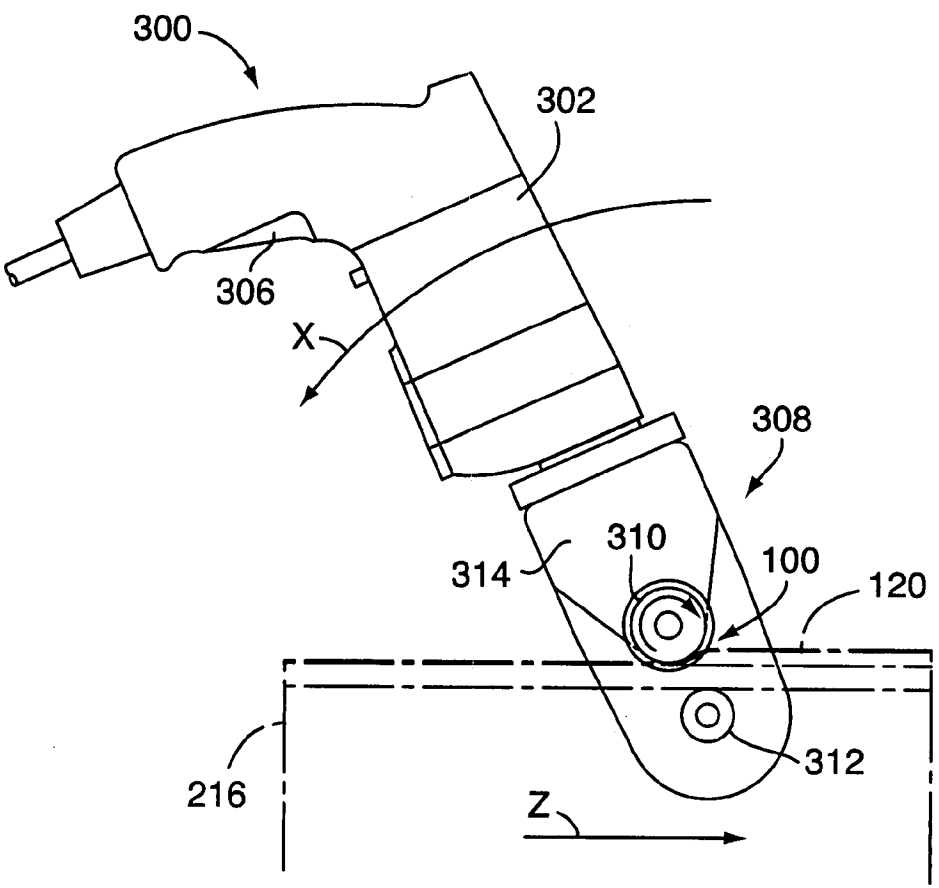
FIG. 11 illustrates the seam closing apparatus of FIG. 9 as it is operated to seal the outwardly extending sealing portion of the seam.

Once engaged with the fastseam 100, pressure is applied to the fastseam 100 by rotating the seam closing apparatus 300 in the general direction of the arrow X, as shown in FIG. 11. Actuation of the trigger 306 then causes drive roller 310 to rotate, thus flattening the partially angled sealing portion 120 captured between the drive roller 310 and the idler roller 312.

The drive roller 310 will rotate in the clockwise direction (as seen in FIGS. 10 and 11), propelling the seam closing tool 300 in the direction of arrow Z while flattening the sealing portion 120 to its completely sealed position. It will be readily appreciated that fastseams of varying dimensions may be accommodated via an appropriate rotation of the housing 302.

It is therefore an important aspect of the present invention that the seam closing tool 300 also utilizes only a single, driven roller 310 to bend or form the sealing portion 120 to its completely sealed position. Moreover, by employing only a single driven roller 310 (which is not preceded by a plurality of additional, incremental rollers) the seam closing apparatus 300 of the present invention will permit the driven roller 310 to transverse and seal the entirety of the fastseam 100 without requiring the additional time, expense and audible discomfort of a hammering operation.

Figure 12:
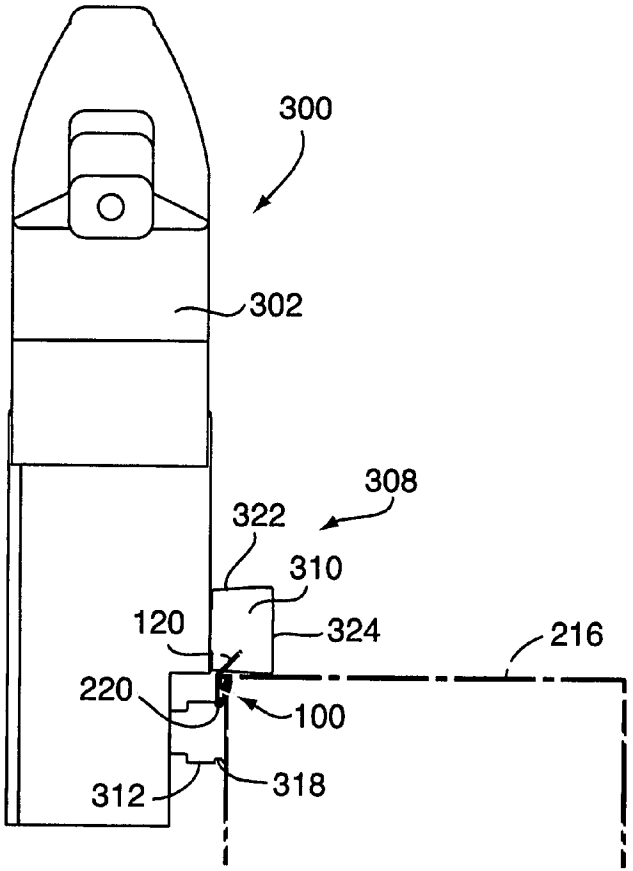
FIG. 12 is a partial cross-sectional view of the seam closing apparatus of FIG. 9 as it engages the seam of a duct.

FIG. 12 illustrates a partial cross-section end view of the seam closing apparatus 300 as it is engaged with the fastseam 100. As shown in FIG. 12, the idler roller 312 includes an annular groove 318 which serves to receive the lower bend 220 (also shown in FIG. 2) of the fastseam 100, thereby ensuring a secure lock upon, and tracking of, the fastseam 100 as the seam closing apparatus 300 is driven down the length of the fastseam 100.

It should also be noted that the driven roller 310 includes an angled profile 322 such that, as shown in the cross-sectional view of FIG. 12, the circumference of the driven roller 310 is smaller in the area adjacent the seam closing apparatus 300 than it is at the exterior side 324 of the driven roller 310. In this manner, the eccentrically formed driven roller 310 ensures a tight seal of the sealing portion 120 against the duct wall 216.

Figure 13:
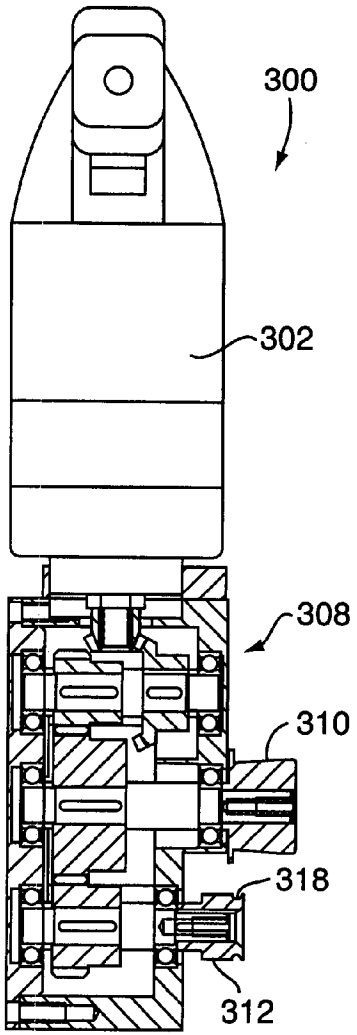
FIG. 13 is a partial cross-sectional view of the operation end of the seam closing apparatus shown in FIG. 9.

FIG. 13 illustrates the a cross-sectional view of the operation end 308, including internal gearing comprised of bevel and spur gears for increased power transmission and quiet operation, contained therein. In accordance with another embodiment of the present invention, and as shown in FIG. 13, the internal gearing of the seam closing apparatus 300 may be arranged such that the idler roller 312 may also be driven by the (unillustrated) motor contained within the housing 302. That is, with particular respect to FIGS. 9–12, the idler roller 312 may itself be driven along with the drive roller 310, thus reducing fatigue and increasing closing and travel speed down the length of the fastseam 100.

As will be appreciated by consideration of the embodiments illustrated in FIGS. 3–13, the present invention provides a seam closing apparatus for ducts having a heretofore unknown ease of use and flexibility. Moreover, as is best seen in FIGS. 5 and 12, the present invention rotatably mounts the drive roller and the idler roller upon differing planar surfaces of the operation end of the seam closing apparatus. As each of these planar surfaces are discontinuous from one another, they provide the appropriate orientation, in a step-like fashion, to accommodate and align the outwardly extending sealing portion and the lower fold of the fastseam.

The seam closing apparatus of the present invention also advantageously promotes a quicker initial assembly of the ductwork without requiring labor intensive and oftentimes painfully loud hammering operations. Another inherent benefit of the present invention resides in the ability of the seam closing apparatus to transverse the entire length of a given duct seam. These benefits, coupled with the inherent benefits of the fastseam illustrated herein, provide a level of comfort and ease of assembly not previously realized with prior art seam closing systems.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A seam closing apparatus for use in sealing a duct seam having an outwardly extending sealing portion and a lower fold, said seam closing apparatus comprising:

a handle portion having a power actuation trigger;

a first roller comprising a first exterior side and a first annular surface connected thereto;

a second roller located proximate and axially parallel to the first roller and comprising a second exterior side, a second annular surface connected to the second exterior side, and an annular groove formed in the second annular surface proximate the second exterior side for engaging said lower fold of said duct seam;

wherein the first annular surface of the first roller extends substantially past the second exterior side of the second roller for engaging said outwardly extending sealing portion of said duct seam; and wherein operation of said power actuation trigger causes said first roller to rotate in a first direction, thereby flattening said outwardly extending sealing portion of said duct seam.

2. The seam closing apparatus according to claim 1, wherein:

operation of said power actuation trigger causes said second roller to rotate in a second direction, said second direction being opposite to said first direction.

3. The seam closing apparatus according to claim 2, wherein:

said first roller and said second roller share a common drive source.

4. The seam closing apparatus according to claim 1, wherein:

the first exterior side of the first roller defines a first end of the first annular surface and first roller, said end having a first diameter; and the annular groove of the second roller lies opposite a second end of the first annular surface, said second end having a second diameter less than the first diameter.

5. The seam closing apparatus according to claim 1, wherein:

said first annular surface and said second annular surface do not substantially directly oppose one another.

6. The seam closing apparatus according to claim 5, wherein:

said first roller is mounted to an operation end of said seam closing apparatus; and said first roller includes an angled profile such that a diameter of said first roller is not uniform and increases in an axial direction extending outwardly past the end of the second roller.

7. The seam closing apparatus according to claim 1, wherein:

said first and said second rollers are rotatably mounted to an operation end of said seam closing apparatus; and an idler handle is pivotably connected to said operation end wherein said second roller may be selectively engaged via operation of said idler handle.

8. The seam closing apparatus according to claim 7, wherein:

said idler handle is operatively connected to said second roller such that pivoting of said idler handle causes said second roller to move from a first non-engaging position to a second engaging position.

9. A hand-held seam closing apparatus for use in sealing a duct seam having an outwardly extending sealing portion and a lower fold, said seam closing apparatus comprising:

a handle portion having a power actuation trigger for selectively enabling operation of said hand-held seam closing apparatus;

a pair of opposing, axially parallel rollers rotatably mounted upon a distal end of said hand-held seam closing apparatus, said pair of opposing rollers being operatively mounted in a step-wise manner such that said pair of opposing rollers are offset from one another with an annular outer surface portion of a first of said rollers extending substantially past an end of a second of said rollers;

wherein the second roller includes an annular groove positioned proximate the end of the second roller for engaging said lower fold of said duct seam; and wherein operation of said power actuation trigger causes said one of said pair of opposing rollers to rotate in a first direction.

10. The hand-held seam closing apparatus according to claim 9, wherein:

operation of said power actuation trigger causes said pair of opposing rollers to each rotate in opposing directions to one another.

11. The hand-held seam closing apparatus according to claim 10, wherein:

said opposing rollers each share a common drive source.

12. The hand-held seam closing apparatus according to claim 10, further comprising:

an idler handle pivotably mounted to said distal end; and wherein one of said opposing rollers may be selectively engaged with said duct seam via operation of said idler handle.

13. The hand-held seam closing apparatus according to claim 12, wherein:

said idler handle is operatively connected to one of said opposing rollers such that pivoting of said idler handle causes one of said opposing rollers to move from a first non-engaging position away from said duct seam to a second engaging position in contact with said duct seam.

14. The hand-held seam closing apparatus according to claim 9, wherein:

the annular outer surface of the first roller is frusto-conical in shape for biasing said sealing portion, wherein said annular groove is positioned proximate the end of the second roller and opposite an end of the fusto-conical outer surface having a shortest diameter of the outer surface.

15. The hand-held seam closing apparatus according to claim 9, wherein:

the first roller is eccentrically formed.

16. The hand-held seam closing apparatus according to claim 15, wherein:

the first roller is mounted to a mounting surface on said distal end; and the first roller includes an angled profile such that a diameter of said first roller increases in an axial direction extending outwardly from said mounting surface of said distal end.

17. A method for sealing a duct seam having an outwardly extending sealing portion and a lower fold, said method comprising the steps of:

engaging the lower fold with an annular groove located proximate an end of a first roller;

engaging the sealing portion with an annular outer surface of a second roller located proximate and axially parallel to the first roller; and rotating at least one of the rollers, wherein the outer annular surface of the second roller extends substantially past the end of the first roller for folding the sealing portion over towards the lower fold.

18. The method for sealing a duct seam according to claim 17, said method further comprising the steps of:

rotating the rollers in opposing directions to one another.

19. The method for sealing a duct seam according to claim 18, said method further comprising the steps of:

forming the outer annular surface of the second roller to include an angled profile such that a diameter of the second roller increases in an axial direction extending outwardly past the end of the first roller.

* * * * *